US008867968B2

(12) United States Patent
Buchanan et al.

(10) Patent No.: US 8,867,968 B2
(45) Date of Patent: Oct. 21, 2014

(54) MOVABLE TONER PORT COVER MEMBER FOR A REPLACEABLE UNIT OF AN IMAGING DEVICE

(75) Inventors: John Andrew Buchanan, Paris, KY (US); James Anthany Carter, Lexington, KY (US); Gregory Alan Cavill, Winchester, KY (US); Nicholas Fenley Gibson, Lexington, KY (US); Michael Craig Leemhuis, Nicholasville, KY (US); Tyler Frederick Williams, Georgetown, KY (US); Mark Duane Foster, Lexington, KY (US); Thomas Wilbur Blanck, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 70 days.

(21) Appl. No.: 13/420,956

(22) Filed: Mar. 15, 2012

(65) Prior Publication Data

US 2013/0170869 A1 Jul. 4, 2013

Related U.S. Application Data

(60) Provisional application No. 61/581,842, filed on Dec. 30, 2011.

(51) Int. Cl.
*G03G 15/08* (2006.01)

(52) U.S. Cl.
USPC ..... 399/258; 399/120

(58) Field of Classification Search
USPC ..... 399/258, 262, 119, 120
See application file for complete search history.

(56) References Cited

U.S. PATENT DOCUMENTS

| | | | | |
|---|---|---|---|---|
| 5,083,158 | A | 1/1992 | Kashima et al. | |
| 5,608,501 | A | 3/1997 | Makino | |
| 5,758,233 | A | 5/1998 | Coffey et al. | |
| 5,848,342 | A * | 12/1998 | Tanda | 399/120 X |
| 6,128,453 | A | 10/2000 | Ban et al. | |
| 6,259,874 | B1 | 7/2001 | Murakami et al. | |
| 6,266,505 | B1 | 7/2001 | Ban et al. | |
| 6,594,458 | B2 | 7/2003 | Ban et al. | |
| 6,792,228 | B2 | 9/2004 | Ban et al. | |
| 6,853,828 | B2 | 2/2005 | Ban et al. | |
| 6,968,139 | B2 | 11/2005 | Ban et al. | |
| 6,978,101 | B2 | 12/2005 | Ban et al. | |
| 7,386,250 | B2 | 6/2008 | Ban et al. | |

(Continued)

FOREIGN PATENT DOCUMENTS

JP 2000-356895 A * 12/2000

OTHER PUBLICATIONS

U.S. Appl. No. 13/340,797, filed Dec. 30, 2011.

(Continued)

*Primary Examiner* — Sophia S Chen
(74) *Attorney, Agent, or Firm* — William F. Esser

(57) ABSTRACT

A rotating cover on the developer unit of an imaging apparatus to prevent toner leaks from the toner entry port of the developer unit. When installing a toner cartridge, the cartridge contacts a surface to cause the cover to rotate to an open position, thereby exposing the toner port for receiving toner. Conversely, when the toner cartridge is removed the cover is rotated into a closed position with the aid of a torsion spring so as to seal the toner entry port of the developer unit.

35 Claims, 9 Drawing Sheets

(56) References Cited

U.S. PATENT DOCUMENTS

| | | | | |
|---|---|---|---|---|
| 7,421,234 | B2 | 9/2008 | Ikeda et al. | |
| 7,548,710 | B2 | 6/2009 | Gayne et al. | |
| 7,606,520 | B2 | 10/2009 | Dawson | |
| 8,165,505 | B2 | 4/2012 | Kojima | |
| 8,588,659 | B2 | 11/2013 | Carter et al. | |
| 2005/0169672 | A1 | 8/2005 | Ban et al. | |
| 2006/0171744 | A1 | 8/2006 | Ikeda et al. | |
| 2007/0003325 | A1 * | 1/2007 | Jung et al. | 399/258 |
| 2007/0212118 | A1 | 9/2007 | Nagae et al. | |
| 2008/0101821 | A1 | 5/2008 | Gayne et al. | |
| 2009/0142103 | A1 | 6/2009 | Chaudhuri et al. | |
| 2013/0170861 | A1 | 7/2013 | Buchanan et al. | |
| 2013/0170864 | A1 | 7/2013 | Newman et al. | |
| 2013/0170865 | A1 | 7/2013 | Carter et al. | |
| 2013/0170866 | A1 | 7/2013 | Carter et al. | |
| 2013/0170868 | A1 | 7/2013 | Acosta et al. | |
| 2013/0170869 | A1 | 7/2013 | Buchanan et al. | |
| 2013/0170872 | A1 | 7/2013 | Buchanan et al. | |

OTHER PUBLICATIONS

Prosecution history for U.S. Appl. No. 13/340,876, including Non-final Office Action dated Nov. 27, 2013.
Prosecution history for U.S. Appl. No. 13/340,881, including Notice of Allowance dated Oct. 11, 2013.
Prosecution history for U.S. Appl. No. 13/340,884, including Notice of Allowance dated Oct. 22, 2013.
Prosecution history for U.S. Appl. No. 13/780,042, filed Feb. 28, 2013.
Prosecution history for U.S. Appl. No. 13,340,797, including the Notice of Allowance dated Oct. 9, 2013.
Prosecution history for U.S. Appl. No. 13/723,888, including the Notice of Allowance dated Feb. 26, 2014.

* cited by examiner

MOVABLE TONER PORT COVER MEMBER FOR A REPLACEABLE UNIT OF AN IMAGING DEVICE

CROSS REFERENCES TO RELATED APPLICATIONS

Pursuant to 35 U.S.C. §119, this application claims the benefit of the earlier filing date of Provisional Application Ser. No. 61/581,842, filed Dec. 30, 2011, entitled "Movable Toner Port Cover Member for a Replaceable Unit of an Imaging Device," the content of which is hereby incorporated by reference herein in its entirety.

BACKGROUND

1. Technical Field

Example embodiments are directed to a cover for a toner port of a replaceable unit of an imaging device, and particularly to a movable cover for the toner input port of a developer unit of an electrophotographic imaging device that is displaced upon the operational engagement of a toner cartridge with the developer unit.

2. Description of Related Art

Cartridges within printers are more readily becoming separated into two or more units in order to separate longer and shorter life components. When these components are connected, toner must pass from one unit to the other as needed. The area where the components connect is generally called a toner port. Many cartridges use foam or flexible seals to keep the toner contained at this connection. When the cartridge and the imaging unit are removed from the printer there is the potential for toner to escape from the sealing surfaces and the areas around the toner port. This loose toner can contaminate the printer, desk, or the user's clothing thus causing customer dissatisfaction. Toner covers have been used on printer cartridges but they typically are a sliding shutter design which has potential to skive off toner onto the surroundings. As a result, such toner covers contribute to the same toner contamination problem they are intended to prevent.

Based upon the foregoing, there is a need for an improved toner port for a replaceable unit of an imaging device.

SUMMARY

Example embodiments of the present disclosure overcome shortcomings with prior interfaces between toner cartridges and developer units and thereby satisfy a significant need for an improved interface therefor. According to an example embodiment, there is shown a developer unit for an electrophotographic imaging device, including a housing having a volume defined therein for holding toner; a toner input port disposed on the housing and having an opening for the transfer of toner; and a cover member rotatably coupled to the housing for covering the toner input port when in a closed position and allowing for the transfer of toner when in an open position relative to the toner input port. The cover member may include a protrusion extending therefrom such that application of a force on the protrusion causes the cover member to move towards the open position. Such a force may be generated, for example, during insertion of a toner cartridge into the electrophotographic imaging device so as to engage and operatively cooperate with the developer unit disposed therein.

In addition, the developer unit may include a spring member coupled between the housing and the cover member, for biasing the cover member towards the closed position. This allows for automatic closure of the cover member when the developer unit is no longer engaged with the toner cartridge, such as when the toner cartridge is withdrawn from the electrophotographic imaging device.

Instead of a protrusion as described above, alternative example embodiments include a linkage assembly coupled to the housing of the developer unit and the cover member for moving the cover member between open and closed positions relative to the toner input port. The linkage assembly may include a plurality of linkage members, one of which is contacted by the toner cartridge during installation thereof in the imaging device. A second linkage member is coupled between the first linkage member and the cover member such that movement of the first linkage member by the toner cartridge causes the cover member to move to an open position exposing the toner input port, thereby allowing for the establishment of a toner supply path between the developer unit and the toner cartridge.

DETAILED DESCRIPTION

Figure 1:
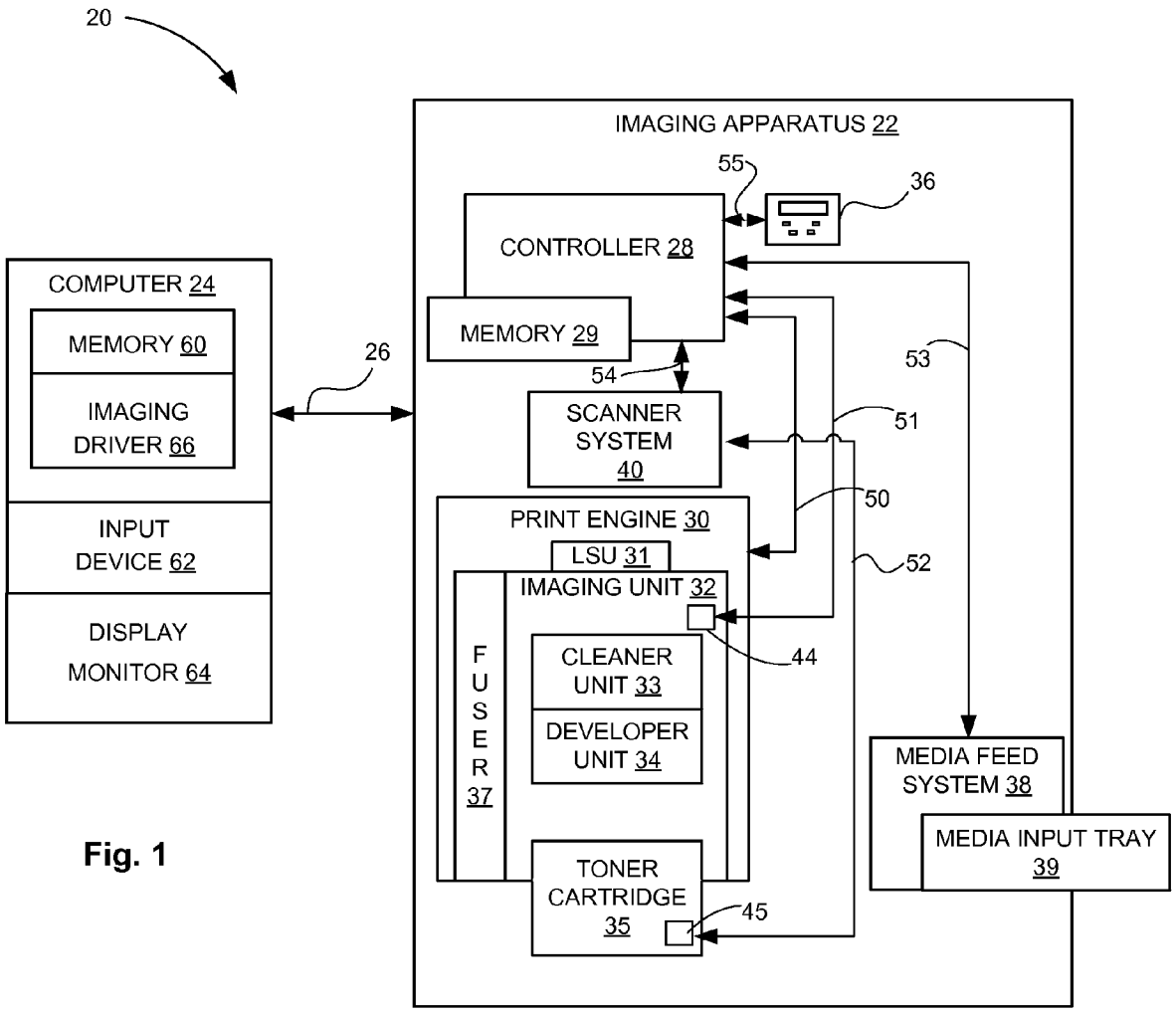
FIG. 1 is a block diagram of an example imaging system utilizing the imaging unit of the present disclosure.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Terms such as "first", "second", and the like, are used to describe various elements, regions, sections, etc. and are not intended to be limiting. Further, the terms "a" and "an" herein do not denote a limitation of quantity, but rather denote the presence of at least one of the referenced item.

Furthermore, and as described in subsequent paragraphs, the specific configurations illustrated in the drawings are intended to exemplify embodiments of the disclosure and that other alternative configurations are possible.

Reference will now be made in detail to the example embodiments, as illustrated in the accompanying drawings. Whenever possible, the same reference numerals will be used throughout the drawings to refer to the same or like parts.

In FIG. 1, there is shown a diagrammatic depiction of an imaging system 20 embodying the present disclosure. As shown, imaging system 20 may include an imaging apparatus 22 and a computer 24. Imaging apparatus 22 communicates with computer 24 via a communications link 26. As used herein, the term "communications link" is used to generally refer to any structure that facilitates electronic communication between multiple components, and may operate using wired or wireless technology and may include communications over the Internet.

In the embodiment shown in FIG. 1, imaging apparatus 22 is shown as a multifunction machine that includes a controller 28, a print engine 30, a laser scan unit (LSU) 31, an imaging unit 32, a developer unit 34, a toner cartridge 35, a user interface 36, a media feed system 38 and media input tray 39, and a scanner system 40. Imaging apparatus 22 may communicate with computer 24 via a standard communication protocol, such as for example, universal serial bus (USB), Ethernet or IEEE 802.xx. A multifunction machine is also sometimes referred to in the art as an all-in-one (AIO) unit. Those skilled in the art will recognize that imaging apparatus 22 may be, for example, an electrophotographic printer/copier including an integrated scanner system 40 or a standalone scanner system 40.

Controller 28 includes a processor unit and associated memory 29, and may be implemented as one or more Application Specific Integrated Circuits (ASICs). Memory 29 may be any volatile and/or non-volatile memory such as, for example, random access memory (RAM), read only memory (ROM), flash memory and/or non-volatile RAM (NVRAM). Alternatively, memory 29 may be in the form of a separate electronic memory (e.g., RAM, ROM, and/or NVRAM), a hard drive, a CD or DVD drive, or any memory device convenient for use with controller 28. Controller 28 may be, for example, a combined printer and scanner controller.

In the present embodiment, controller 28 communicates with print engine 30 via a communications link 50. Controller 28 communicates with imaging unit 32 and processing circuitry 44 thereon via a communications link 51. Controller 28 communicates with toner cartridge 35 and processing circuitry 45 therein via a communications link 52. Controller 28 communicates with media feed system 38 via a communications link 53. Controller 28 communicates with scanner system 40 via a communications link 54. User interface 36 is communicatively coupled to controller 28 via a communications link 55. Processing circuitries-44, 45 may provide authentication functions, safety and operational interlocks, operating parameters and usage information related to imaging unit 32 and toner cartridge 35, respectively. Controller 28 serves to process print data and to operate print engine 30 during printing, as well as to operate scanner system 40 and process data obtained via scanner system 40.

Computer 24, which may be optional, may be, for example, a personal computer, electronic tablet, smartphone or other hand-held electronic device, including memory 60, such as volatile and/or non-volatile memory, an input device 62, such as a keyboard or keypad, and a display monitor 64. Computer 24 further includes a processor, input/output (I/O) interfaces, and may include at least one mass data storage device, such as a hard drive, a CD-ROM and/or a DVD unit (not shown).

Computer 24 includes in its memory a software program including program instructions that function as an imaging driver 66, e.g., printer/scanner driver software, for imaging apparatus 22. Imaging driver 66 is in communication with controller 28 of imaging apparatus 22 via communications link 26. Imaging driver 66 facilitates communication between imaging apparatus 22 and computer 24. One aspect of imaging driver 66 may be, for example, to provide formatted print data to imaging apparatus 22, and more particularly, to print engine 30, to print an image. Another aspect of imaging driver 66 may be, for example, to facilitate collection of scanned data.

In some circumstances, it may be desirable to operate imaging apparatus 22 in a standalone mode. In the standalone mode, imaging apparatus 22 is capable of functioning without computer 24. Accordingly, all or a portion of imaging driver 66, or a similar driver, may be located in controller 28 of imaging apparatus 22 so as to accommodate printing and scanning functionality when operating in the standalone mode.

Print engine 30 may include laser scan unit (LSU) 31, imaging unit 32, and a fuser 37, all mounted within imaging apparatus 22. The imaging unit 32 further includes a cleaner unit 33 housing a waste toner removal system and a photoconductive drum and developer unit 34 which is removably mounted within print engine 30 of imaging apparatus 32. Developer unit 34 may include components typically found in a developer unit of an electrophotographic imaging apparatus, such as a developer roll, toner adder roll and doctor blade. In one embodiment, the cleaner unit 33 and developer unit 34 are assembled together and installed onto a frame of the imaging unit 32. The toner cartridge 35 is then installed on or in proximity with the frame in a mating relation with the developer unit 34. Laser scan unit 31 creates a latent image on the photoconductive drum in the cleaner unit 33. The developer unit 34 has a toner sump containing toner which is transferred to the latent image on the photoconductive drum to create a toned image. The toned image is subsequently transferred to a media sheet received in the imaging unit 32 from media input tray 39 for printing. Toner remnants are removed from the photoconductive drum by the waste toner removal system. The toner image is bonded to the media sheet in the fuser 37 and then sent to an output location or to one or more finishing options such as a duplexer, a stapler or hole punch.

Figure 2:
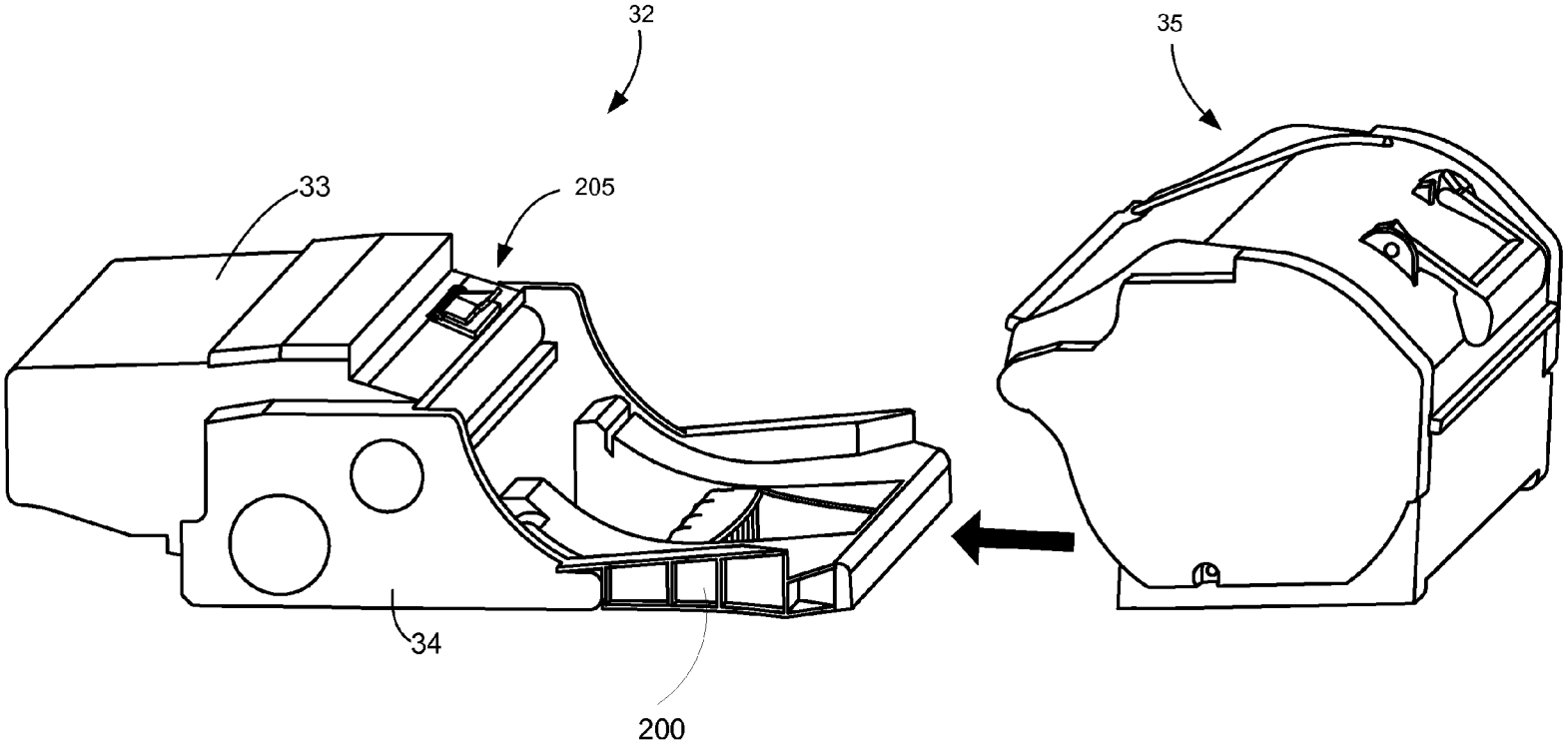
FIG. 2 is a perspective view of an imaging unit and toner cartridge of FIG. 1 in accordance with an example embodiment.

Referring now to FIG. 2, an example embodiment of imaging unit 32 is shown. Imaging unit 32, as illustrated, includes developer unit 34, cleaner unit 33 and a frame 200. Developer unit 34 and cleaner unit 33 are assembled onto or otherwise secured to frame 200. The imaging unit 32 without toner cartridge 35 is initially slidably received into imaging apparatus 22. The toner cartridge 35 is then slidingly inserted along frame 200 until it is operatively coupled to developer unit 34. This arrangement allows toner cartridge 35 to be separately removed and reinserted easily when replacing an empty toner cartridge or during media jam removal. The developer unit 34, cleaning unit 33 and frame 200 may also be readily slidingly removed and reinserted as a single unit when required. However, this would normally occur with less frequency than the removal and reinsertion of toner cartridge 35.

As mentioned, the toner cartridge 35 removably mates with the developer unit 34 of imaging unit 32. An exit port (not shown) on the toner cartridge 35 communicates with an inlet port 205 on the developer unit 34 allowing toner to be periodically transferred from the toner cartridge 35 to resupply the toner sump in the developer unit 34. Developer unit 34 may include an internal shutter (not shown) which slides in relation to toner inlet port 205 and prevents toner located in the toner sump from exiting toner inlet port 205.

With respect to FIGS. 2-7, example embodiments of the present disclosure are directed to a cover mechanism 300 for toner inlet port 205 of imaging unit 32. The cover mechanism 300 is designed to prevent the contamination of surfaces upon the installation, removal, and transportation of toner imaging unit 32 or developer unit 34 thereof. According to an example embodiment, the cover mechanism 300 includes a rotatable door or cover 302 designed to contain toner within the developer unit 34 of imaging unit 32. The rotatable door 302 prevents toner leaks from imaging unit 32 while located inside the printer and unconnected to toner cartridge 35 or when transporting imaging unit 32. Cover mechanism 300 includes, in addition to the rotatable door 302, a bias member 308 (FIGS. 4 and 5) for biasing the rotatable door 302 in the closed position over toner inlet port 205, and arms 310.

As mentioned, the imaging unit 32 receives toner from toner cartridge 35 through toner inlet port 205 when needed for ensuring a sufficient supply of toner is available for printing. The toner inlet port 205 of the imaging unit 32 includes a generally rectangular or oblong shaped opening for receiving toner. Toner inlet port 205 may include a seal 304 surrounding the opening of toner inlet port 205. Seal 304 may be constructed from a compressible foam material. Toner inlet port 205 may be disposed along one side of developer unit 34 of imaging unit 32. The toner cartridge 35, having a toner output port located on a lower surface of the cartridge feeds toner to imaging unit 32 using augers and gravity.

Figure 3:
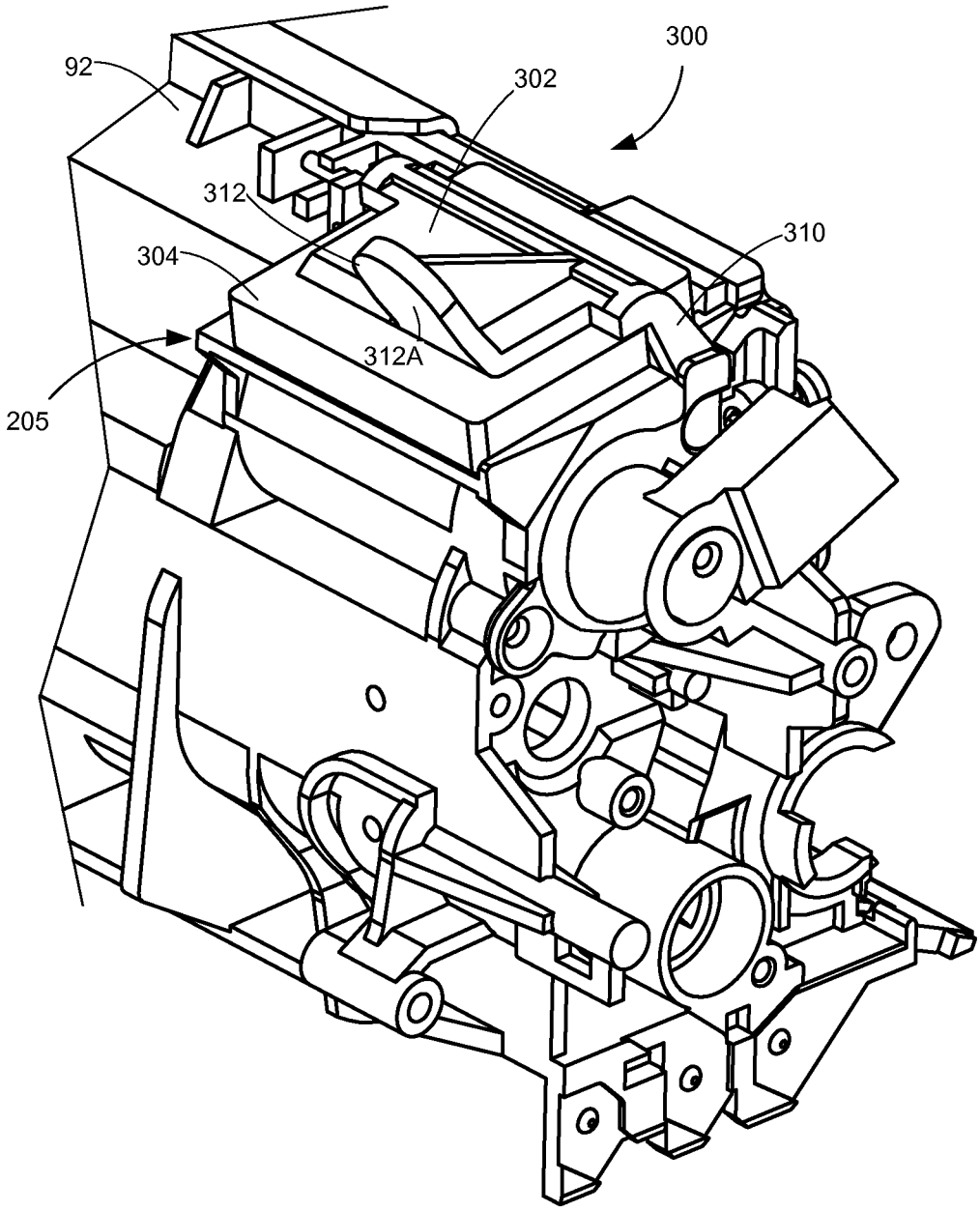
FIG. 3 is a perspective partial view of an imaging unit according to an example embodiment.
Figure 4:
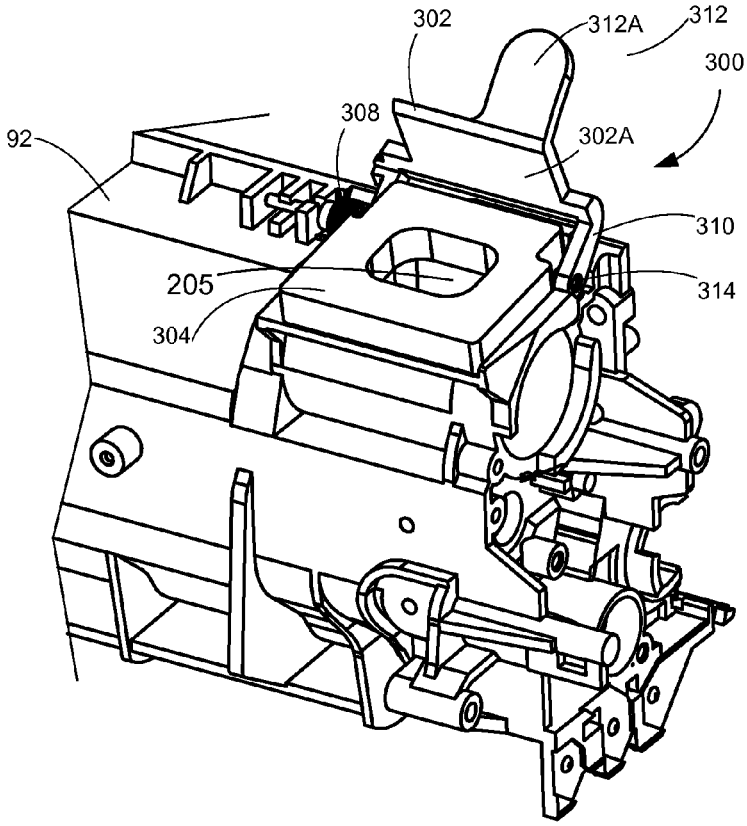
FIGS. 4 and 5 are perspective views of a cover member of FIG. 3 in the open and closed positions, respectively, relative to the imaging unit.
Figure 5:
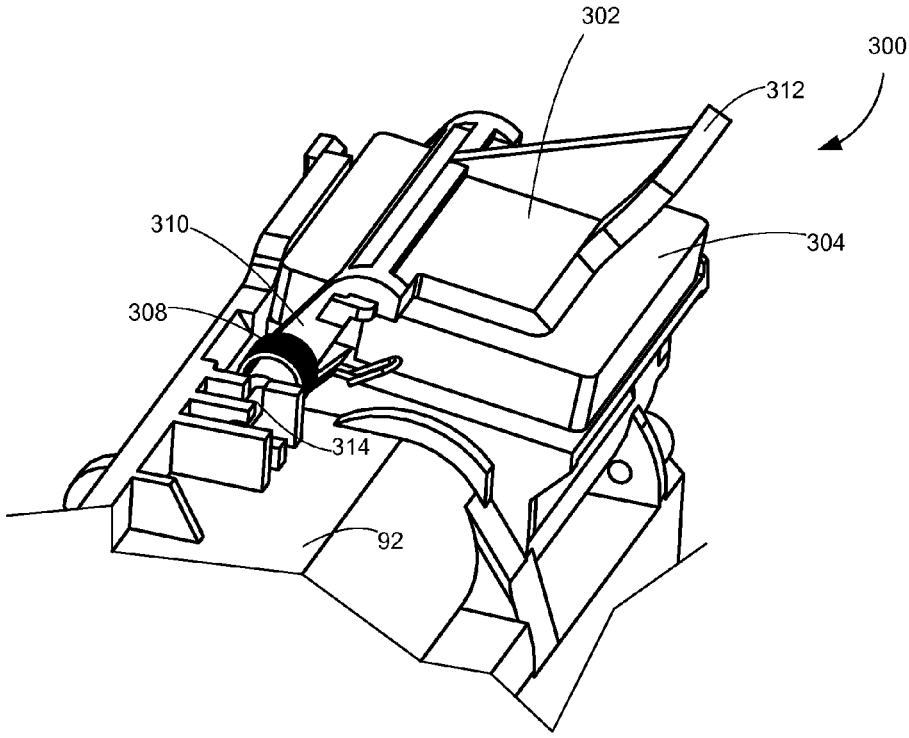

Rotatable door 302 rests on seal 304 of toner inlet port 205 when in the closed position (FIGS. 3 and 5). When in the closed position, door 302 prevents toner that may be disposed around toner inlet port 205 from leaking from imaging unit 32. Such toner may include toner which is not trapped within the toner sump of developer unit 34 by the closed shutter thereof but may instead be disposed along a surface of toner inlet port 205. The rotatable door 302 interfaces with toner cartridge 35, the engagement of which causes the rotatable door 302 to move to the open position. The door 302 may be rigid, formed from a plastic composition, for example. Door 302 may have a substantially flat surface 302A (FIG. 4) which rests upon seal 304 of toner inlet port 205. Door 302 may also include a protrusion 312 extending therefrom which engages with or is otherwise contacted by the toner cartridge 35 when the latter is installed in the printer. In the example embodiment shown in FIG. 3, protrusion 312 includes a surface 312A for engaging with toner cartridge 35. In an example embodiment, surface 312A may be a curved, convex surface corresponding to a relatively large radius, such as about 100 mm. Surface 312A may be angled relative to surface 302A of door 302 to facilitate easy rotation thereof. In an example embodiment, the angle θ (FIG. 6) formed between protrusion 312 and surface 302A of door 302 may be between 90 degrees and 180 degrees and in particular may be about 135 degrees. When rib 402 of toner cartridge 35 contacts surface 312A of protrusion 312 during cartridge installation, protrusion 312 and the rest of rotatable door 302 pivot to a near vertical position out of the way of the cartridge 35, thereby exposing the toner inlet port 205 for depositing toner therein. The engagement between toner cartridge 35 and rotatable door 302 will be described in greater detail below.

Figure 6:
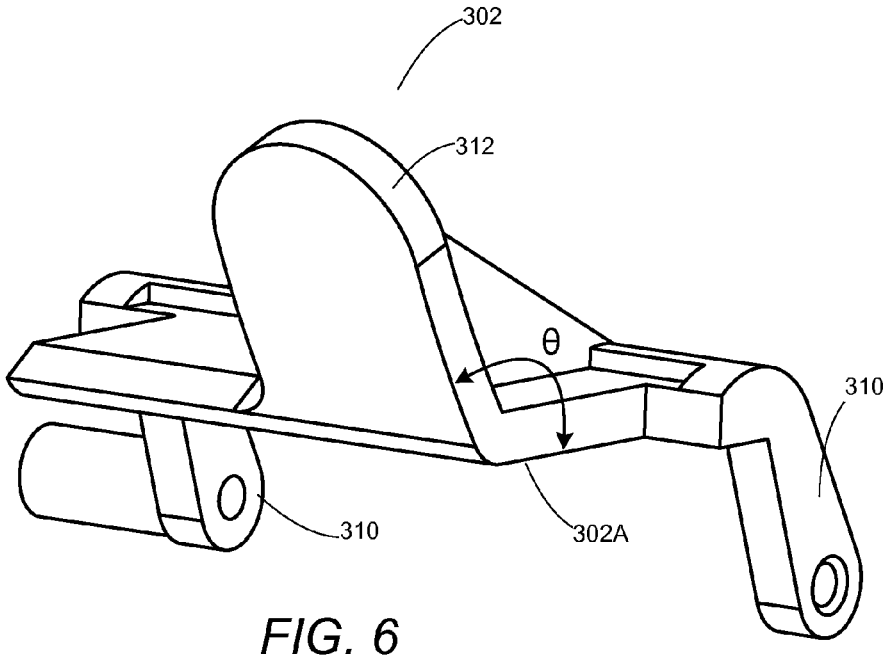
FIG. 6 is an elevational view of the cover member of FIG. 3.

Best seen in FIGS. 4-6, arms 310 of door 302 extend from opposed sides of door 302, each arm 310 having a distal end portion for pivotably mounting the rotatable door 302 to the housing 92 of the developer unit 34 of imaging unit 32. A shaft 314 (FIGS. 4 and 5), mounted on the top of the developer unit 34, is operably coupled to arms 310 for allowing arms 310 and the rest of door 302 to rotate. Shaft 314 and arms 310 may form a hinge about which rotatable door 302 rotates or pivots between its closed position (FIGS. 3 and 5) and open position (FIG. 4).

Bias member 308 may be formed of a torsion spring that is mounted along shaft 314 and coupled to housing 92 of imaging unit 32 and to an arm 310 so as to keep door 302 in contact with the flexible foam seal 304 of toner inlet port 205 in the closed position, preventing toner from escaping out the input toner port area of the developer unit 34. It is understood that bias member 308 may be other types of springs for biasing door 302 towards the closed position.

Figure 7:
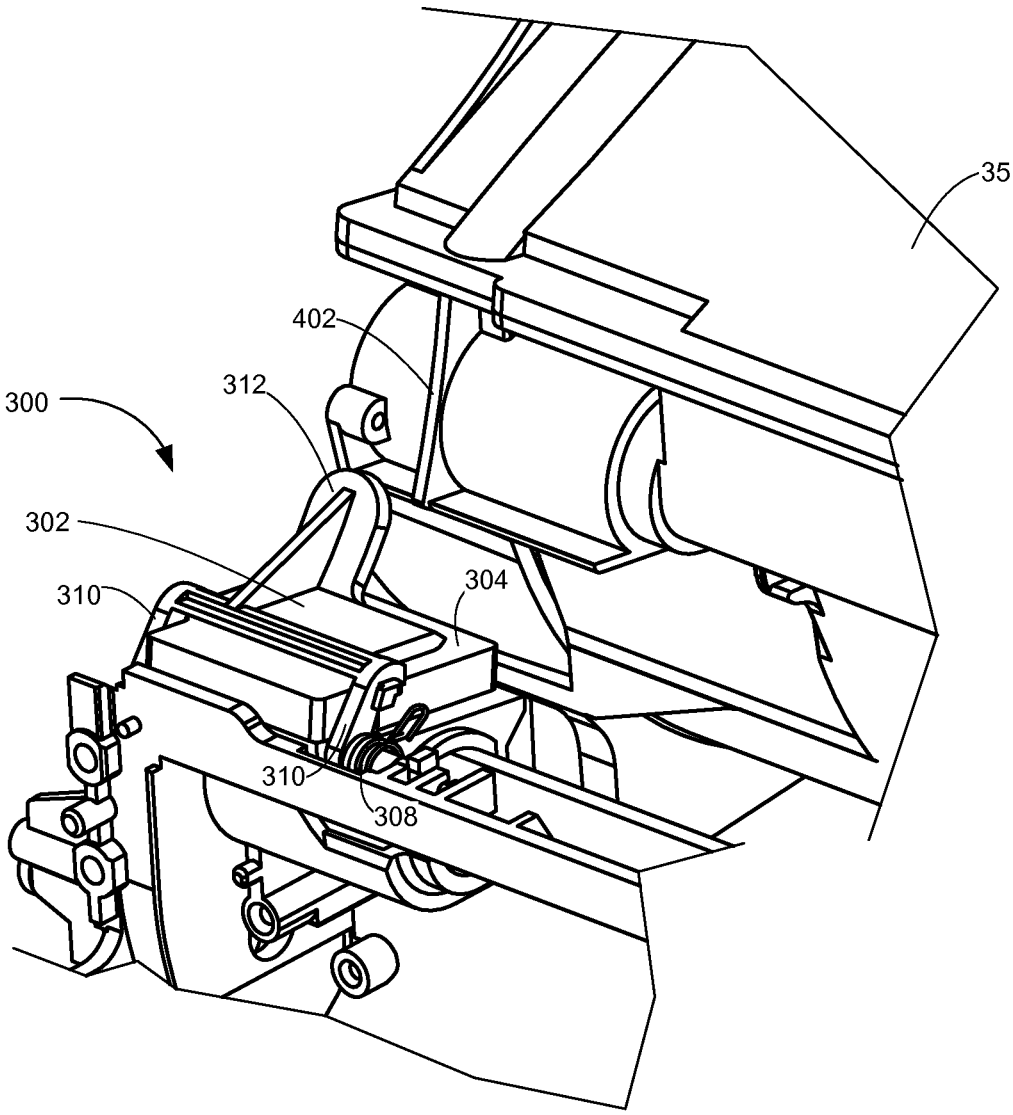
FIG. 7 is a perspective view of the cover member and imaging unit prior to engagement with a toner cartridge.
Figure 8A:
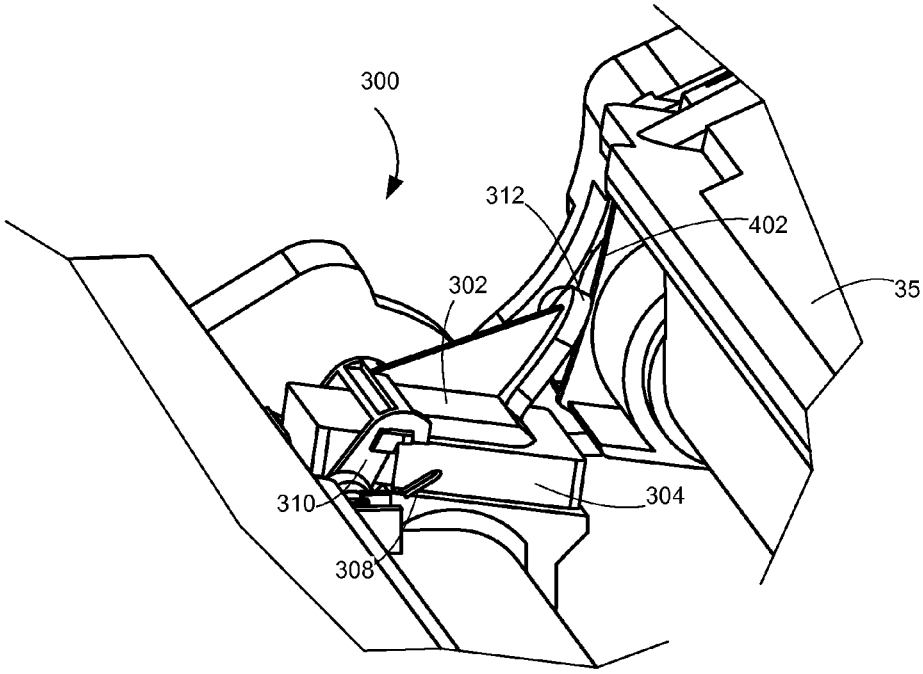
FIGS. 8A-8C are perspective views depicting movement of the cover member of FIG. 3 during engagement of and mating by a toner cartridge with the imaging unit of FIG. 3.
Figure 8B:
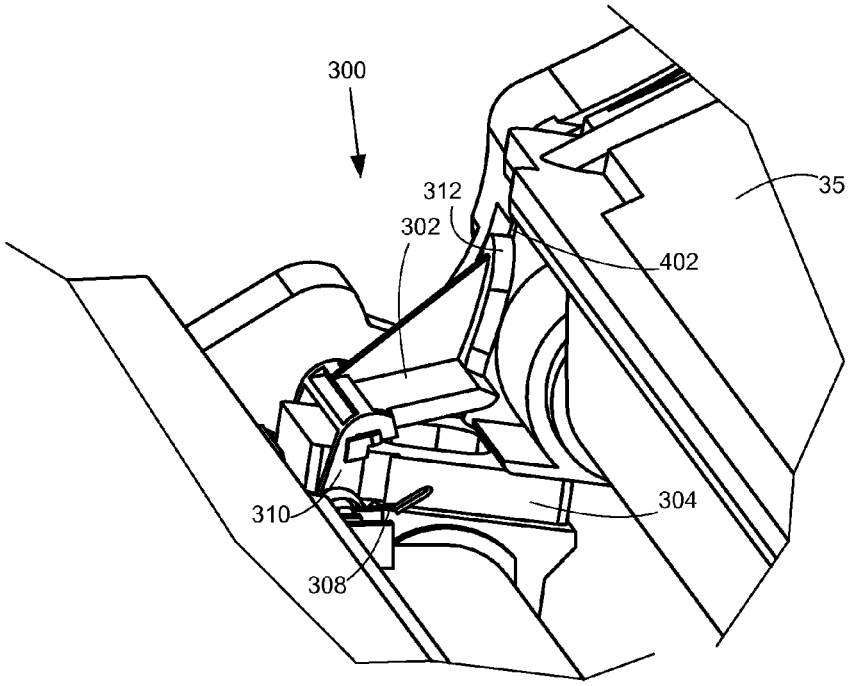
Figure 8C:
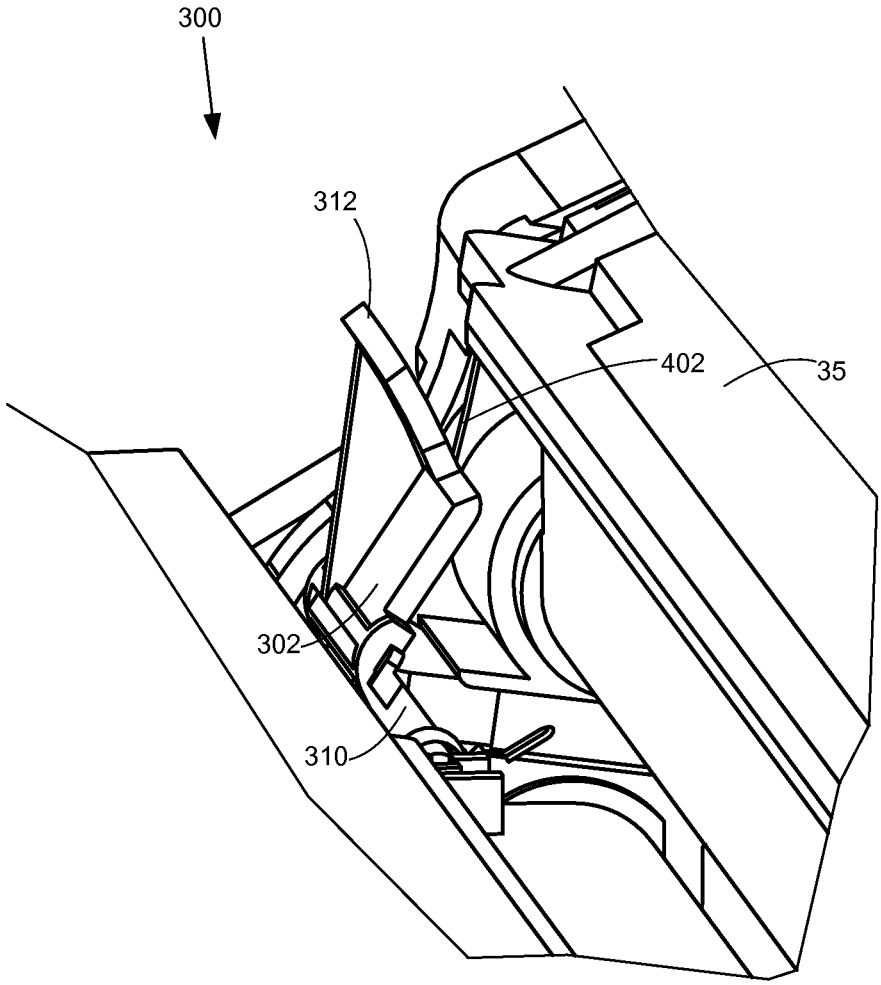

FIG. 7 illustrates toner cartridge 35 and cover mechanism 300 during insertion of toner cartridge 35 prior to engagement with imaging unit 32, and FIGS. 8A-8C illustrate toner cartridge 35 and cover assembly 300 during toner cartridge insertion initially prior to and following contact between toner cartridge 35 and rotatable door 302. Following insertion of imaging unit 32 within the printer, when the cartridge 35 is installed into the printer (FIG. 8A) along a set of guides (not shown), a rib 402 on the front of the cartridge 35 contacts surface 312A of protrusion 312 of rotatable door 302 and causes the rotatable door 302 to rotate or pivot away from the flexible seal 304 (FIG. 8B), until following further cartridge insertion door 302 is sufficiently out of the way and into a more vertical orientation (FIG. 8C). With rotatable door 302 now being in the open position, final insertion of toner cartridge 35 causes the toner output port of toner cartridge 35 to sealingly engage with toner inlet port 205 to create a sealed toner path between toner cartridge 35 and imaging unit 32.

When in the open position, the rotatable door 302 is biased against the front of the cartridge 35 due to the force provided by the bias member 308. In an example embodiment, a relatively small amount of spring force is applied by bias member 308 onto the cartridge 35 which reduces the total applied forces on the other components in the printing system. Upon removal of the cartridge 35, the rotatable door 302 returns to the closed position due to bias member 308 exerting a force thereon. Rotatable door 302 slides along rib 402 of toner cartridge 35 during withdrawal thereof until door 302 comes to rest upon the flexible seal 304.

Figure 9:
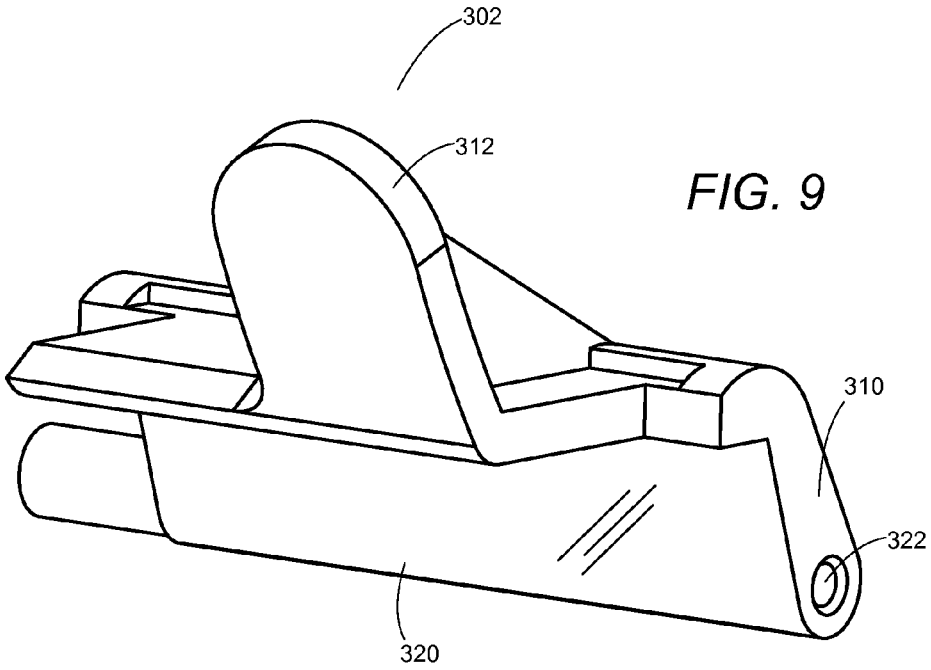
FIG. 9 is an elevational view of a cover member according to another example embodiment.

In an alternative embodiment, door or cover 302 moves between open and closed positions in a path other than a rotational path. As shown in FIG. 9, in another alternative embodiment, door 302 includes a single, relatively wide arm 320 which extends outwardly from door 302 and includes at its distal end a through-bore 322 for receiving shaft 314 therein.

Figure 10:
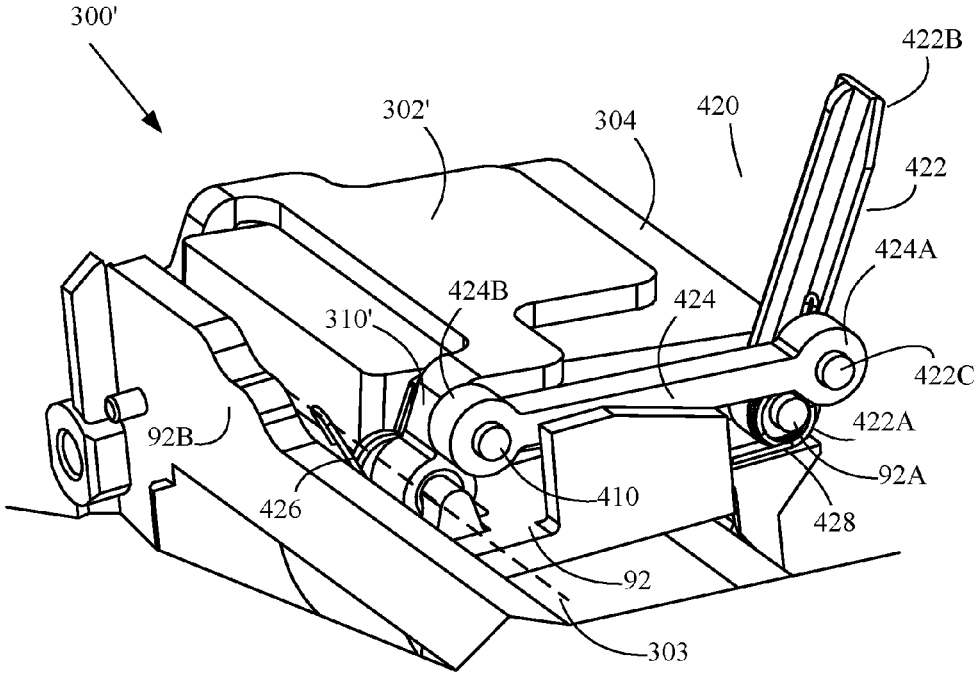
FIGS. 10 and 11 are perspective views of the cover member in closed and open positions, respectively, according to an alternative embodiment of the present disclosure.
Figure 11:
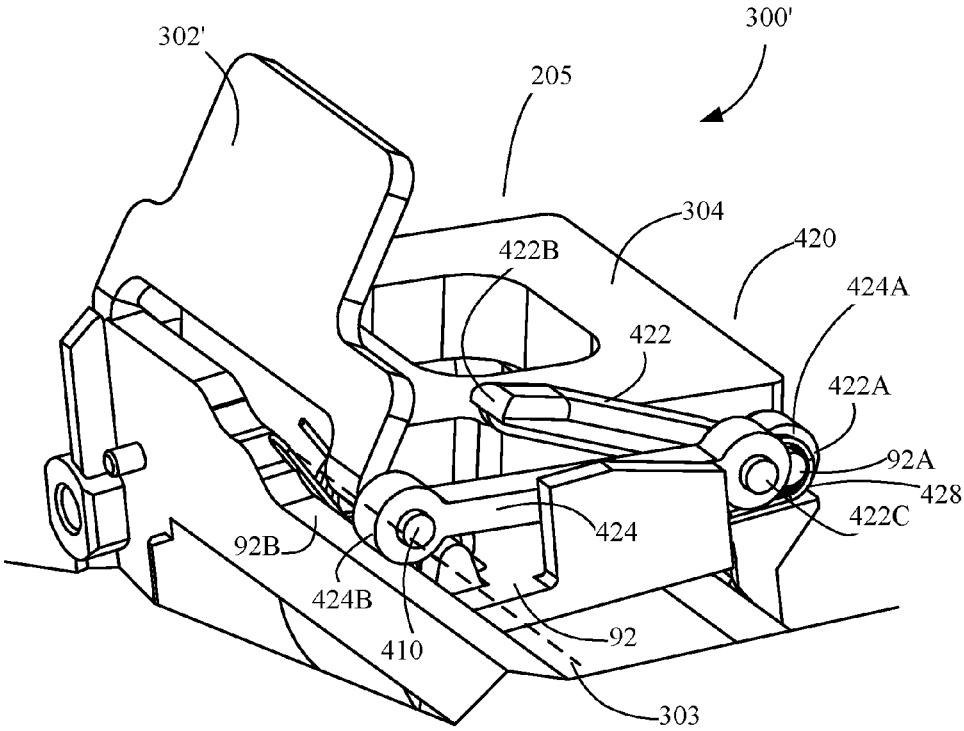

With respect to FIGS. 10 and 11, there is shown a cover mechanism 300' according to another example embodiment. Cover mechanism 300' may include a door or cover member 302' which is sized for covering the opening of toner inlet port 205 when in the closed position over seal 304. Door member 302' may include arms 310' which extend from opposed sides of door member 302'. A distal end of each arm 310' may pivotally attach to housing 92 of developer unit 34. At least one arm 310' may include a pivot post 410 which extends outwardly therefrom.

Cover mechanism 300' may further include a linkage assembly 420 for facilitating movement of door member 302' from the closed position (FIG. 10) covering toner inlet port 205 to an open position (FIG. 11) for exposing the opening of toner inlet port 205 for establishing a toner path between developer unit 34 and toner cartridge 35. Linkage assembly 420 may include a first elongated linkage member 422 having a first end 422A pivotally coupled to housing 92 about pivot post 92A of housing 92. An unconnected second end 422B of first elongated linkage member 422 may include a cam surface for being contacted by rib 402 of toner cartridge 35, as described in greater detail below. First elongated linkage member 422 may further include a pivot post 422C disposed between first end 422A and second end 422B and extending outwardly therefrom.

Linkage assembly 420 may further include a second elongated linkage member 424 having a first end 424A pivotally coupled to first elongated linkage member 422 about pivot post 422C. Second elongated linkage member 424 includes a second end 424B which is pivotally coupled to arm 310' of door member 302' about pivot post 410. First and second elongated linkage members 422 and 424 are rigid and may be constructed from a plastic or other composition.

Cover mechanism 300' may further include a bias member for biasing door member 302' to the closed position for covering inlet port 205 when developer unit 34 is not operatively mated with toner cartridge 35. The bias member may include a spring 426 operatively coupled to door member 302' for presenting a bias force to move door member 302' to the closed position in the absence of other forces acting thereon. Spring 426 may be a torsion spring which, as shown in FIG. 10, is centered about a rotational axis 303 of door member 302' having a first end which contacts housing 92 and a second end that contacts door member 302'. In this way, spring 426 urges door member 302' to rotate towards seal 304.

Cover mechanism 300' may further include a second spring 428 which is coupled to housing 92 and first elongated linkage member 422 so as to rotate first elongated linkage member 422 to its extended position (FIG. 10). In this way, spring 426 and the second spring 428 together serve to move door member 302' to the closed position over toner inlet port 205. In another example embodiment, the second spring 428 is employed without spring 426. It is understood that the choice of the number and location of springs to use for rotating door member 302' to the closed position may be based upon a number of factors including the particular characteristics of the linkage assembly 420, such as the linear position between pivot posts 92A and 422C and between pivot post 410 and the rotational axis 303 of door member 302', and the angular positioning, relative to the horizontal, of first elongated linkage member 422 when door member 302' is in the open position.

The operation of cover mechanism 300' will be described with continued reference to FIGS. 10 and 11. With imaging unit 32 installed in imaging apparatus 22, door member 302' is in the closed position (FIG. 10) over toner inlet port 205 such that toner disposed just inside foam seal 304 of toner inlet port 205 is substantially prevented from leaking. In the closed position, first elongated linkage member 422 extends outwardly from toner inlet port 205.

As toner cartridge 35 is inserted in imaging apparatus 22, rib 402 of toner cartridge 35 contacts outwardly extending second end 422B of first elongated linkage member 422. Continued insertion of toner cartridge 35 within imaging apparatus 22 causes rib 402 of toner cartridge 35 to pivot first elongated linkage member 422 about pivot post 92A. From the perspective of FIG. 10, first elongated linkage member 422 rotates in a counterclockwise direction. The rotation of first elongated linkage member 422 pushes second elongated linkage member 424 in a direction towards a leading end 92B of housing 92 for developer unit 34. Due to the connection between second elongated linkage member 424 and door member 302' at pivot post 410, the movement of second elongated linkage member 424 causes door member 302' to rotate about its rotational axis 303. Door member 302' rotates until it is in the open position (FIG. 11), thereby exposing the opening of toner inlet port 205 so that the toner outlet port of toner cartridge 35 may sealingly engage therewith for providing a toner supply path to developer unit 34. When door member 302' is in the open position, first elongated linkage member 422 is positioned in a folded position, under the profile of seal 304.

As toner cartridge 35 is removed from imaging apparatus 22, which may occur when toner cartridge 35 is substantially empty of toner and needs to be replaced, door member 302' returns to the closed position due to spring 426 exerting a force thereon. First elongated member 422 rotates in a clockwise direction, when viewed from FIGS. 10 and 11, with second end 422B sliding along rib 402 of toner cartridge 35 during withdrawal thereof until door member 302' comes to rest upon the flexible seal 304.

An advantage of cover mechanism 300' of FIGS. 10 and 11 over cover mechanism 300 of FIGS. 3-8 is that because door member 302' does not include protrusion 312, the clearance or swing radius for door member 302' to move between closed and open positions is noticeably less, thereby allowing developer unit 34 having cover mechanism 300' to operate in tighter confines. Further, separating the surface that is contacted by rib 402 of toner cartridge 35 from door member 302' advantageously allows greater freedom in implementing the cam profile for cover mechanism 300'.

According to another example embodiment, a cover mechanism may include two linkage assemblies 420 disposed along opposed sides of toner inlet port 205. In such a dual linkage assembly implementation, each set of first and second elongated linkage members 422, 424 is coupled to a distinct arm 310' of door member 302'.

It is understood that the positions of pivot posts 92A, 422C and 410 may vary to create a desired opening speed for door member 302' and the final position thereof when in the open position with toner cartridge 35 fully seated with toner inlet port 205. In addition, by varying the position of pivot post 92A of housing 92 and the shape of the surface of second end 422B of first elongated linkage member 422 which is contacted by toner cartridge 35, a cam angle of about 90 degrees may be reached.

It is understood that the cover mechanism as described above can be utilized in a developer unit irrespective of the particular architecture selected for the toner cartridge, developer unit and photoconductive unit. For example, the cover mechanism may be utilized in developer units forming part of a removable imaging unit, such as imaging unit 32, and in developer units that are separate from a unit housing the photoconductive drum of the imaging apparatus.

The foregoing description of several methods and embodiments has been presented for purposes of illustration. It is not intended to be exhaustive or to limit the disclosure to the precise acts and/or forms disclosed, and obviously many modifications and variations are possible in light of the above teaching. It is intended that the scope of the invention be defined by the claims appended hereto.

We claim:

1. A developer unit for an electrophotographic imaging device, comprising:

a housing having a volume defined therein for holding toner to be developed;

a toner inlet port disposed on the housing having an aperture for receiving toner; and a cover member rotatably coupled to the housing for covering the toner inlet port when in a closed position and allowing for the reception of toner within the housing when in an open position relative to the toner inlet port, the cover member rotating outwardly relative to the housing when the cover member moves toward the open position.

2. The developer unit of claim 1, wherein the cover member includes a protrusion extending therefrom such that application of a force on the protrusion causes the cover member to move towards the open position.

3. The developer unit of claim 2, wherein the protrusion includes a contact surface and the cover member includes a surface which covers the toner inlet port when in the closed position, the contact surface of the protrusion and the surface of the cover member forming an angle between 90 degrees and 180 degrees.

4. The developer unit of claim 2, wherein the protrusion includes a contact surface, the contact surface being oriented such that application of the force against the contact surface causes the cover member to rotate, the contact surface being convex.

5. The developer unit of claim 1, further comprising a bias member coupled to the cover member and to the housing for biasing the cover member in the closed position over the toner inlet port.

6. The developer unit of claim 1, wherein the cover member comprises:

a first member providing a surface area which covers the toner inlet port when the cover member is in the closed position; and at least one arm coupled to the first member and having a distal end portion pivotably coupled to the housing.

7. The developer unit of claim 6, wherein the at least one arm comprises a plurality of arms, each arm being coupled to the first member and having a distal end portion pivotably coupled to the housing, the cover member pivoting about an axis defined at least in part by the distal end portion of the arms.

8. The developer unit of claim 1, further comprising:

a first elongated member having a first end pivotally attached to the housing; and a second elongated member having a first end pivotally attached to the first elongated member and a second end pivotally attached to the cover member such that application of a force against a second end portion of the first elongated member causes the cover member to rotate from the closed position to the open position.

9. The developer unit of claim 8, wherein the cover member includes a first member providing a surface area which covers the toner inlet port when the cover member is in the closed position and at least one arm coupled to the first member and having a distal end portion pivotably coupled to the housing, the second end of the second elongated member being pivotally attached to the at least one arm between a pivot axis of the cover member and the first member thereof.

10. The developer unit of claim 8, wherein the first end of the second elongated member is pivotally attached to the first elongated member between the first end and the second end portion thereof.

11. A developer unit for an electrophotographic imaging device, comprising:

a housing having a volume defined therein for holding toner to be developed;

a toner inlet port disposed on the housing and having an aperture for receiving toner; and a door member coupled to the housing for covering the toner inlet port when in a closed position and exposing the toner inlet port when in an open position relative thereto, the door member being lifted outwardly from toner inlet port when moving from the closed position to the open position.

12. The developer unit of claim 11, wherein the door member includes a first portion having a surface for covering the toner inlet port when in the closed position and a protrusion extending from the first portion and positioned relative thereto so that application of a force on the protrusion causes the door member to move from the closed position to the open position.

13. The developer unit of claim 12, wherein the protrusion includes a contact surface which extends from the surface of the first portion of the door member forming an angle greater than 90 degrees and less than 180 degrees.

14. The developer unit of 11, further comprising a spring coupled to the door member and the housing for biasing the door member in the closed position.

15. The developer unit of claim 11, wherein the door member includes at least one arm extending outwardly therefrom, a distal end portion of the at least one arm being rotatably coupled to the housing so that the door member is rotatably coupled thereto.

16. The developer unit of claim 15, further comprising at least one shaft coupling the at least one arm to the housing such that the door member rotates about the at least one shaft.

17. The developer unit of claim 15, wherein the at least one arm comprises a pair of arms extending from opposed sides of the door member.

18. The developer unit of claim 11, further comprising a linkage mechanism coupled to the housing and the door member for moving the door member from the closed position to the open position upon application of a force on the linkage mechanism.

19. The developer unit of claim 18, wherein the linkage mechanism comprises:

a first elongated member having a first end pivotally attached to the housing and a second end; and a second elongated member having a first end pivotally attached to the first elongated member and a second end pivotally attached to the door member such that application of a force at or near the second end of the first elongated member causes the first elongated member to rotate about the first end thereof, the second elongated member to move in response to rotation of the first elongated member, and the door member to move from the closed position to the open position.

20. The developer unit of claim 19, wherein the first end of the second elongated member is attached to the first elongated member between the first and second ends thereof.

21. The developer unit of claim 18, further comprising at least one bias member coupled to the housing for biasing the door member in the closed position.

22. The developer unit of claim 21, wherein the at least one bias member comprises a first bias member coupled between the housing and the linkage mechanism and a second bias member coupled between the housing and the door member.

23. A developer unit for an electrophotographic imaging device, comprising:

a housing having a volume defined therein for holding toner to be developed;

a toner inlet port disposed on the housing having an aperture for receiving toner; and a cover member rotatably coupled to the housing for covering the toner inlet port when in a closed position and allowing for the reception of toner within the housing when in an open position relative to the toner inlet port, wherein the cover member comprises:

a first member providing a surface area which covers the toner inlet port when the cover member is in the closed position; and at least one arm coupled to the first member and having a distal end portion pivotably coupled to the housing.

24. The developer unit of claim 23, wherein the at least one arm comprises a plurality of arms, each arm being coupled to the first member and having a distal end portion pivotably coupled to the housing, the cover member pivoting about an axis defined at least in part by the distal end portion of each arm.

25. A developer unit for an electrophotographic imaging device, comprising:

a housing having a volume defined therein for holding toner to be developed;

a toner inlet port disposed on the housing having an aperture for receiving toner;

a cover member rotatably coupled to the housing for covering the toner inlet port when in a closed position and allowing for the reception of toner within the housing when in an open position relative to the toner inlet port;

a first elongated member having a first end pivotally attached to the housing; and a second elongated member having a first end pivotally attached to the first elongated member and a second end pivotally attached to the cover member such that application of a force against a second end portion of the first elongated member causes the cover member to rotate from the closed position to the open position.

26. The developer unit of claim 25, wherein the cover member includes a first member providing a surface area which covers the toner inlet port when the cover member is in the closed position and at least one arm coupled to the first member and having a distal end portion pivotably coupled to the housing, the second end of the second elongated member being pivotally attached to the at least one arm between a pivot axis of the cover member and the first member thereof.

27. The developer unit of claim 25, wherein the first end of the second elongated member is pivotally attached to the first elongated member between the first end and the second end portion of the first elongated member.

28. A developer unit for an electrophotographic imaging device, comprising:

a housing having a volume defined therein for holding toner to be developed;

a toner inlet port disposed on the housing and having an aperture for receiving toner; and a door member coupled to the housing for covering the toner inlet port when in a closed position and exposing the toner inlet port when in an open position relative thereto, the door member being lifted from the toner inlet port when moving from the closed position to the open position, wherein the door member includes at least one arm extending outwardly therefrom, a distal end portion of the at least one arm being rotatably coupled to the housing so that the door member is rotatably coupled thereto.

29. The developer unit of claim 28, further comprising at least one shaft coupling the at least one arm to the housing such that the door member rotates about the at least one shaft.

30. The developer unit of claim 28, wherein the at least one arm comprises a pair of arms extending from opposed sides of the door member.

31. A developer unit for an electrophotographic imaging device, comprising:

a housing having a volume defined therein for holding toner to be developed;

a toner inlet port disposed on the housing and having an aperture for receiving toner;

a door member coupled to the housing for covering the toner inlet port when in a closed position and exposing the toner inlet port when in an open position relative thereto, the door member being lifted from the toner inlet port when moving from the closed position to the open position; and a linkage mechanism coupled to the housing and the door member for moving the door member from the closed position to the open position upon application of a force on the linkage mechanism.

32. The developer unit of claim 31, wherein the linkage mechanism comprises:

a first elongated member having a first end pivotally attached to the housing and a second end; and a second elongated member having a first end pivotally attached to the first elongated member and a second end pivotally attached to the door member such that application of a force at or near the second end of the first elongated member causes the first elongated member to rotate about the first end thereof, the second elongated member to move in response to rotation of the first elongated member, and the door member to move from the closed position to the open position.

33. The developer unit of claim 32, wherein the first end of the second elongated member is attached to the first elongated member between the first and second ends of the first elongated member.

34. The developer unit of claim 31, further comprising at least one bias member coupled to the housing for biasing the door member in the closed position.

35. The developer unit of claim 34, wherein the at least one bias member comprises a first bias member coupled between the housing and the linkage mechanism and a second bias member coupled between the housing and the door member.

* * * * *